US007802523B2

(12) United States Patent
Moritzhuber et al.

(10) Patent No.: US 7,802,523 B2
(45) Date of Patent: Sep. 28, 2010

(54) CABLE RAILWAY SYSTEM

(75) Inventors: Johannes Moritzhuber, Hard (AT); Markus Beck, Fussach (AT)

(73) Assignee: Innova Patent GmbH, Wolfurt (AT)

( * ) Notice: Subject to any disclaimer, the term of this patent is extended or adjusted under 35 U.S.C. 154(b) by 73 days.

(21) Appl. No.: 12/269,250

(22) Filed: Nov. 12, 2008

(65) Prior Publication Data

US 2010/0018434 A1 Jan. 28, 2010

(30) Foreign Application Priority Data

Jul. 24, 2008 (AT) ..... A 1152/2008

(51) Int. Cl.
*B61B 12/00* (2006.01)

(52) U.S. Cl. ..... 104/173.1; 104/178; 104/179; 105/149; 105/149.1; 105/149.2

(58) Field of Classification Search ..... 104/173.1, 104/178, 179; 105/149, 149.1, 149.2; 356/149, 356/614, 621, 622
See application file for complete search history.

(56) References Cited

U.S. PATENT DOCUMENTS

| | | | | |
|---|---|---|---|---|
| 3,348,499 | A * | 10/1967 | Sowder | 104/178 |
| 5,528,219 | A * | 6/1996 | Frohlich et al. | 340/540 |
| 6,393,995 | B1 * | 5/2002 | Mugnier | 104/173.1 |
| 2007/0034105 | A1 * | 2/2007 | Mugnier | 104/178 |
| 2007/0221088 | A1 * | 9/2007 | Hinteregger | 104/178 |
| 2010/0018434 | A1 * | 1/2010 | Moritzhuber et al. | 104/178 |

FOREIGN PATENT DOCUMENTS

| | | | |
|---|---|---|---|
| EP | 1837264 | A2 | 9/2007 |
| JP | 63279962 | A | 11/1988 |
| JP | 257923 | A | 2/1990 |
| WO | 9530216 | A1 | 11/1995 |

OTHER PUBLICATIONS

European Search Report dated Dec. 10, 2009.

* cited by examiner

*Primary Examiner*—Mark T Le
*Assistant Examiner*—Jason C Smith
(74) *Attorney, Agent, or Firm*—Laurence A Greenberg; Werner H Stemer; Ralph E Locher

(57) ABSTRACT

A cable railway system has two or more stations and at least one carrying cable and a conveying cable extending between the stations and guided in the stations by way of deflection pulleys. At least one of the pulleys is driven. Vehicles, such as cable cars or chairs, may be boarded or disembarked from in the stations by the passengers. The system may also have one or more fixed carrying cables along which the cars are moved by way of one or more hauling cables. At least one device is associated with the vehicles along the section of the cable railway system, by way of which device the pendulum movements that the vehicles are subject to transversely relative to the direction of movement of the vehicles are detectable and its output signals are conducted to a device that controls the drive of the cable railway system. The drive is thereby controllable in dependence on the extent of the pendulum movements.

20 Claims, 1 Drawing Sheet

CABLE RAILWAY SYSTEM

CROSS REFERENCE TO RELATED APPLICATION

This application claims the priority, under 35 U.S.C. §119, of Austrian patent application A 1152/2008, filed Jul. 24, 2008; the prior application is herewith incorporated by reference in its entirety.

BACKGROUND OF THE INVENTION

Field of the Invention

The invention relates to a cable railway system with at least two stations, in addition with at least one carrying and conveying cable, which is guided in the stations by way of deflection pulleys. At least one of the main pulleys is driven. Vehicles, such as cable cars, gondolas, or chairs, are couplable to the carrying and conveying cable, uncouplable from the carrying and conveying cable in the stations and are moveable through the stations along guide rails. The vehicles may also be fixedly secured to the carrying and conveying cable. Passengers board the vehicles, or disembark from them, in the stations.

The present invention further relates to a cable railway system with at least two stations and with at least one fixedly disposed carrying cable, on which vehicles, such as cable cars or chairs, are conveyable between the stations by means of at least one traction cable, wherein the vehicles are boarded or respectively disembarked from in the stations by the passengers.

When the cable railway system is in operation, consideration must be given to the fact that, on account of air currents, the vehicles are subject to pendulum movements transversely relative to the direction of travel, the variable of which depends on the directions and the speeds of the air currents. A specific advantage of such cable railway systems that are realized with two carrying cables disposed in parallel, is that the vehicles are only subject to slight pendulum movements. Contrary to this, in the case of such cable railway systems that are realized with only one carrying cable, at high and very high wind speeds, the pendulum movements that the vehicles are subject to can be so great as to pose the danger of the vehicles colliding with operation buildings, with supports of the cable railway system or with vehicles moving in the opposite direction, which is why there is the requirement to reduce the speed of the vehicles or to shut down the operation of the cable railway system.

In the case of cable railway systems known to date, it is incumbent upon the tower operator to estimate whether the pendulum movements of the vehicles transversely relative to the direction of travel are so insignificant that there is no danger of collision or whether, if this is not the case, the speed of the vehicles has to be reduced or the operation of the cable railway system shut down. In this case, however, it has to be taken into consideration that, as a rule, it is not possible to monitor the entire cable railway system visually on account of topographical conditions and that visibility conditions also depend on climatic conditions, as, for example, they deteriorate a good deal when snow has fallen or respectively in fog. In addition, it must be taken into consideration that very different air currents can occur along the route of the cable railway system, which is why the wind speeds existing in individual regions are hardly definitive for the entire cable railway system.

In other words, the fluidic conditions can be very different along the cable railway system, which is why the pendulum movements of the individual vehicles along the cable railway system and accordingly the danger of collisions can be equally variable and very difficult to estimate by monitoring that is carried out from the stations.

SUMMARY OF THE INVENTION

It is accordingly an object of the invention to provide a cable railway system, which overcomes the above-mentioned disadvantages of the heretofore-known devices and methods of this general type and which avoids and helps overcome the disadvantages that occur in prior art cable railway systems.

With the foregoing and other objects in view there is provided, in accordance with the invention, a cable railway system, comprising:

at least two stations and at least one carrying and conveying cable, including at least one driven cable, extending between the stations and guided at the stations by way of deflection pulleys;

vehicles configured to transport passengers along the carrying and conveying cable between the stations and guided through the stations to allow passengers to board or disembark from the vehicles in the stations;

at least one detector device associated with the vehicles and effective along a travel section of the cable railway system between the stations, for detecting a pendulum movement of the vehicles transversely to a direction of movement of the vehicles;

the detector device outputting output signals to a control device of a drive of the cable railway system, wherein the drive of the cable railway system is controllable in dependence on an extent of the pendulum movement of the vehicles.

The vehicles may be cable cars, lift chairs, or gondolas suspended from the carrying and conveying cable.

The vehicles are configured to be coupled to the carrying and conveying cable and uncoupled therefrom in the stations, and to be moved through the stations along guide rails for passengers to board or disembark from the vehicles in the stations. In the alternative, the vehicles may be secured to the carrying and conveying cable for travel between the at least two stations.

In an alternative embodiment, the invention also applies to cable car systems with fixed carrying cables along which the vehicles travel (e.g. on bogies) which being moved by way of haulage or traction cables.

The objects of the invention are achieved in that at least one device is associated with the vehicles along the section of the cable railway system, by means of which device the pendulum movements that the vehicles are subject to transversely relative to the direction of movement of the vehicles are detectable and its output signals are conducted to a device that controls the drive of the cable railway system, the drive thereby being controllable in dependence on the extent of the pendulum movements.

At least one sensor, more especially a laser scanner or respectively an electronic camera, is preferably associated with the vehicles moving along the section, by means of which sensor, on the one hand, the distance between the vehicles and the sensor is detectable and, on the other hand, the variables of their pendulum movements effected transversely relative to the direction of travel are detectable, and the measured value of the pendulum movements that occur at a predetermined distance between the vehicles and the sensor is used to control the drive of the cable railway system. More specifically, a sensor is provided in the region of the stations, by means of which sensor the pendulum movements of the approaching transporting means are detectable.

The measured value of the pendulum movements that is used to control the drive is preferably that which occurs when the vehicle is situated at a distance of approximately 20 m to 30 m away from the entry into a station. When a predetermined measured value of the pendulum movements is exceeded, the cable railway system is preferably shut down. As an alternative to this, when a predeterminable first variable of the measured value of the pendulum movements is exceeded, the drive for the cable railway system can be controlled such that the speed of the transporting means is reduced and when a predetermined second variable of the measured value is exceeded, the drive for the cable railway system is shut down. In addition, as the variables of the pendulum movements increase, the drive for the cable railway system can be controlled such that the speed of the vehicles is reduced.

Other features which are considered as characteristic for the invention are set forth in the appended claims.

Although the invention is illustrated and described herein as embodied in a cable railway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a perspective view of a station of a cable railway system according to the invention.

DETAILED DESCRIPTION OF THE INVENTION

Figure 1:
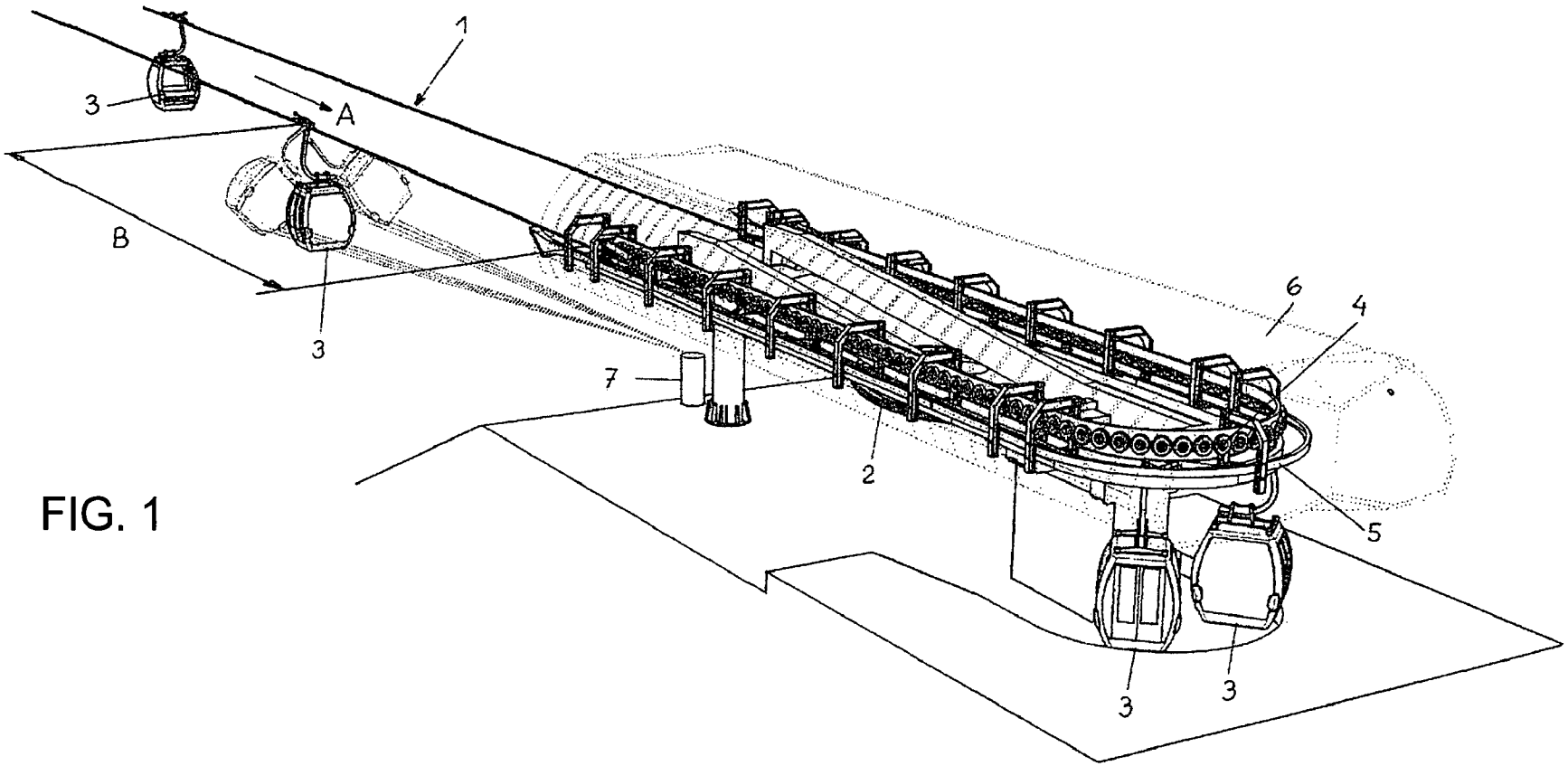

Referring now to the sole FIGURE of the drawing in detail there is shown a station of a cable railway station which is provided with a sensor, by way of which the variables of the pendulum movements of the vehicles entering the station are detectable.

The cable railway station includes a carrying and conveying cable 1, which is guided in the stations by means of deflection pulleys 2. At least one of the deflection pulleys 2 is a driven pulley. An arbitrary number of vehicles (i.e., transportation devices), here in the form of cable cars 3,I are coupled to the carrying and conveying cable 1 along the section of the cable railway system. The cable cars are uncoupled from the carrying and conveying cable 1 in the stations and then moved through the station by means of conveying tires 4 along guide rails 5 at a speed that is substantially slower than the speed of the carrying and conveying cable 1. There, it is possible for the passengers to board or respectively disembark from the cable cars in the station. The traveling speed of the cable cars 3 between the stations may be approx. 6 m/sec, for example, whereas their traveling speed in the entry and exit area is approximately between 0.15 m/sec and 0.35 m/sec.

The station can also be provided with a roof 6.

As is represented in the FIGURE, the cable cars 3 can be subject to strong pendulum movements transversely to the direction of travel A on account of high wind speeds, and these make it necessary either to shut down the cable railway system or at any rate to reduce the traveling speed as there is a danger of collision.

In order to be able to detect the extent of the pendulum movements of the cable cars 3 entering the station, a sensor 7 is provided in the region of the station, by means of which sensor, on the one hand, the distance between the relevant cable car 3 and the sensor 7 is detectable and, on the other hand, the variable of the pendulum movement of the cable car 3 transversely relative to the direction of travel is detectable. In a preferred embodiment, the sensor 7 is embodied as a laser scanner.

The variable of the pendulum movement of the relevant cable car 3 at a predetermined distance B between the cable car 3 and the entry into the station is detected by the sensor 7. If the variable exceeds a predetermined value, the cable railway system is shut down. According to a variant of the embodiment, as soon as the variable of the pendulum movement exceeds a first predetermined value, the drive for the cable railway system is controlled to the effect that the traveling speed of the cable cars 3 is reduced. Then, if the variable of the pendulum movement exceeds a second predetermined value, the cable railway system is shut down.

In order, additionally, to be able to detect the pendulum movements of the cable cars 3 situated along the section of the cable railway system, additional sensors, more especially laser scanners, are preferably provided along the section, the sensors being situated, for example, on the supports of the cable railway system, and by means of which sensors the pendulum movements of the cable cars moving towards the sensors or respectively moving away from the sensors are detectable. The output signals of the sensors are conducted to a control unit, in respect of which output signals the movements controlling the drive for the cable railway system that are necessary on account of the pendulum movements of the cable cars are effected.

Other types of sensors, for example electronic cameras, can be provided in place of the laser scanners.

These types of sensors can be provided for cable railway systems with couplable vehicles and also for cable railway systems with vehicles fixedly clamped to the conveying cable. Further, they are also applicable such cable railway systems where the vehicles are moved along fixed carrying cables by way of traction or haulage cables.

This means that cable railway systems are created where it is possible to detect the pendulum movements of the vehicles independently of the respective conditions of visibility and where it is possible to control the operation of the cable railway system in dependence on the respective fluidic conditions along the cable railway system.

The invention claimed is:

1. A cable railway system, comprising:

at least two stations and at least one carrying and conveying cable extending between said stations and guided at said stations by way of deflection pulleys, said pulleys including at least one driven pulley;

vehicles configured to transport passengers along said carrying and conveying cable between said stations and guided through said stations so that the passengers may board or disembark from respective said vehicles in said stations;

at least one detector device associated with said vehicles and effective along a travel section of the cable railway system between said stations, for detecting and measuring a distance of respective said vehicles from said detector device and a pendulum movement of said vehicles transversely to a direction of movement of said vehicles;

said detector device outputting output signals to a control device of a drive of the cable railway system, wherein said control device is configured to control the drive of the cable railway system in dependence on an extent of the pendulum movement of said vehicles and the distance of said vehicles as measured by said detector device.

2. The cable railway system according to claim 1, wherein said vehicles are cable cars, lift chairs, or gondolas suspended from said carrying and conveying cable.

3. The cable railway system according to claim 1, wherein said vehicles are configured to be coupled to said carrying and conveying cable and uncoupled therefrom in said stations, and to be moved through said stations along guide rails for passengers to board or disembark from said vehicles in said stations.

4. The cable railway system according to claim 1, wherein said vehicles secured to said carrying and conveying cable for travel between said at least two stations.

5. The cable railway system according to claim 1, wherein said detector device includes at least one sensor disposed to measure the distance between said sensor and a respective said vehicle moving along the section and to measure the pendulum movement transversely relative to the direction of travel of said vehicle, for determining whether a measured value of the pendulum movements occurs at a predetermined distance between the vehicles and for controlling the drive of the cable railway system.

6. The cable railway system according to claim 5, wherein said sensor is a laser scanner or an electronic camera.

7. The cable railway system according to claim 5, wherein said sensor is disposed in a region of a respective said station, for detecting a pendulum movement of a vehicle approaching said station.

8. The cable railway system according to claim 1, wherein said sensor is configured to measure a value of the pendulum movement for controlling the drive when said vehicle is located at a spacing distance of approximately 20 m to 30 m from an entry into said station.

9. The cable railway system according to claim 1, wherein said control system is configured to shut down the cable railway system when a predetermined value of the measured value of the pendulum movement is exceeded.

10. The cable railway system according to claim 1, wherein, when a predetermined first variable of the measured value of the pendulum movements is exceeded, a speed of the drive for the cable railway system is reduced, and when a predetermined second variable of the measured value is exceeded, the drive for the cable railway system is shut down.

11. The cable railway system according to claim 10, wherein, when the variables of the pendulum movements increase, the drive for the cable railway system is controlled such that the speed of the vehicles is reduced.

12. A cable railway system, comprising:

at least two stations and at least one fixedly disposed carrying cable and a traction cable;

vehicles to be moved by said traction cable between said stations and to transport passengers along said carrying cable between said stations and guided through said stations so that the passengers may board or disembark from respective said vehicles in said stations;

at least one detector device associated with said vehicles and effective along a travel section of the cable railway system between said stations, for detecting and measuring a distance of respective said vehicles from said detector device and a pendulum movement of said vehicles transversely to a direction of movement of said vehicles;

said detector device outputting output signals to a control device of a drive of the cable railway system, wherein said control device is configured to control the drive of the cable railway system in dependence on an extent of the pendulum movement of said vehicles and the distance of said vehicles as measured by said detector device.

13. The cable railway system according to claim 12, wherein said vehicles are cable cars, lift chairs, or gondolas suspended from said carrying cable.

14. The cable railway system according to claim 12, wherein said detector device includes at least one sensor disposed to measure the distance between said sensor and a respective said vehicle moving along the section and to measure the pendulum movement transversely relative to the direction of travel of said vehicle, for determining whether a measured value of the pendulum movements occurs at a predetermined distance between the vehicles and for controlling the drive of the cable railway system.

15. The cable railway system according to claim 14, wherein said sensor is a laser scanner or an electronic camera.

16. The cable railway system according to claim 14, wherein said sensor is disposed in a region of a respective said station, for detecting a pendulum movement of a vehicle approaching said station.

17. The cable railway system according to claim 12, wherein said sensor is configured to measure a value of the pendulum movement for controlling the drive when said vehicle is located at a spacing distance of approximately 20 m to 30 m from an entry into said station.

18. The cable railway system according to claim 12, wherein said control system is configured to shut down the cable railway system when a predetermined value of the measured value of the pendulum movement is exceeded.

19. The cable railway system according to claim 12, wherein, when a predetermined first variable of the measured value of the pendulum movements is exceeded, a speed of the drive for the cable railway system is reduced, and when a predetermined second variable of the measured value is exceeded, the drive for the cable railway system is shut down.

20. The cable railway system according to claim 19, wherein, when the variables of the pendulum movements increase, the drive for the cable railway system is controlled such that the speed of the vehicles is reduced.

* * * * *